US007264506B2

(12) United States Patent
Mori et al.

(10) Patent No.: US 7,264,506 B2
(45) Date of Patent: Sep. 4, 2007

(54) TERMINAL-MOVABLE CONNECTOR

(75) Inventors: Shigeo Mori, Makinohara (JP); Teruhiko Ohike, Makinohara (JP); Tsuyoshi Mizushima, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/588,299

(22) Filed: Oct. 27, 2006

(65) Prior Publication Data

US 2007/0105427 A1 May 10, 2007

(30) Foreign Application Priority Data

Oct. 27, 2005 (JP) ..... P2005-312940

(51) Int. Cl.
*H01R 13/58* (2006.01)
*H01R 13/73* (2006.01)

(52) U.S. Cl. ..... 439/606; 439/97; 439/559

(58) Field of Classification Search ..... 439/709, 439/712, 713, 724, 779, 801, 813, 97, 589, 439/606

See application file for complete search history.

(56) References Cited

U.S. PATENT DOCUMENTS 4,743,210 A * 5/1988 Schild et al. ..... 439/559
5,417,587 A * 5/1995 Katsuda et al. ..... 439/559
6,464,538 B2 * 10/2002 Miyazaki et al. ..... 439/610
6,632,108 B1 * 10/2003 Hohlfelder ..... 439/709
6,702,612 B2 * 3/2004 Miyazaki et al. ..... 439/559
6,846,204 B2 * 1/2005 Oda ..... 439/709
7,150,631 B2 * 12/2006 Reed et al. ..... 439/34
2004/0033730 A1 * 2/2004 Oda ..... 439/709
2004/0229518 A1 * 11/2004 Landis et al. ..... 439/709
2005/0208782 A1 * 9/2005 Reed et al. ..... 439/34
2006/0019537 A1 * 1/2006 Ishizaki et al. ..... 439/606

FOREIGN PATENT DOCUMENTS

JP 2003-317821 A 11/2003

* cited by examiner

*Primary Examiner*—James R. Harvey
(74) *Attorney, Agent, or Firm*—Sughrue Mion, PLLC

(57) ABSTRACT

A terminal-movable connector includes first support members which are disposed within an inner housing, and are fixed respectively to terminals in such a manner that each first support member is interposed between the inner housing and the corresponding terminal, and are slidable respectively in directions of axes of distal end portions of wires within the inner housing, and a second support member which is disposed in the inner housing, and supports the terminals in a manner to allow these terminals to be moved respectively in the axial directions of the distal end portions of the wires, and has nuts which are aligned respectively with bolt insertion holes formed respectively in electrical connection portions of the terminals.

3 Claims, 6 Drawing Sheets

TERMINAL-MOVABLE CONNECTOR

BACKGROUND OF THE INVENTION

This invention relates to a terminal-movable connector receiving and holding terminals to which mating terminals are screw-fastened, respectively.

There is known one conventional terminal-movable connector in which an end portion of each terminal connected to a wire is connected to one end portion of a bus bar by a bolt and a nut, and the other end portion of the bus bar is connected to a terminal of an external cable by a bolt and a nut (see, for example, Patent Literature 1). This terminal-movable connector will be described with reference to FIG. 6.

As shown in FIG. 6, in the terminal-movable connector 100, the wire 150 is received in a housing 102, using a rubber plug 101, and a conductor 151 of the wire 150 is connected to the terminal 103. The terminal 103 connected to the wire 150 is connected to the one end portion of the generally L-shaped bus bar 106 by screwing the bolt 104 into the nut 105. The terminal 161 of the external cable 160 is connected to the other end portion of the bus bar 106 by screwing the bolt 107 into the nut 108.

In this terminal-movable connector 100, in order to absorb a positional variation (that is, an offset) of the terminal 103 for the terminal 161 of the external cable 160, the one end portion of the bus bar 106 for relay purposes is provisionally fixed to the terminal 103 by the bolt 104 and the nut 105, and then the bolt 107 and the nut 108 at the other end portion of the bus bar 106 (which is to be connected to the terminal 161) are completely tightened, and then the bolt 104 and the nut 105 are completely tightened.

At this time, in case there is a relative offset between the terminal 161 of the external cable 160 and the bus bar 106, the bolt 104 and the nut 105 are shifted in an upward-downward direction (FIG. 6), utilizing a bolt slot 109 in the terminal 103 and a nut receiving portion 110 of the housing 102 which is larger in size than the nut 105, and by doing so, the offset of the bus bar 106 relative to the terminal 161 of the external cable 160 is absorbed.

Therefore, two sets of bolts and nuts are required for one bus bar 106, and therefore the number of the parts increases. And besides, the screwing operations must be effected respectively at the two regions, that is, for the set of bolt 104 and nut 105 and the set of bolt 107 and nut 108. Furthermore, the bolt-screwing directions are different from each other, and more specifically are perpendicular to each other, and therefore a plurality of openings must be provided for effecting the screwing operations respectively in the different directions, and also the outer size must be increased. As a result, the housing has the increased size.

Patent Literature 1: JP-A-2003-317821 Publication

This invention has been made in view of the above circumstances, and an object of the invention is to provide a terminal-movable connector in which the number of parts can be reduced, and also the position of each terminal can be adjusted with a simple structure.

SUMMARY OF THE INVENTION

The above object has been achieved by a terminal-movable connector of the present invention having features recited in the following Paragraphs (1) to (3).

(1) A terminal-movable connector comprising:

a terminal that includes one end portion having a bolt insertion hole through which a mating terminal can be fixed to the one end portion by a bolt, and the other end portion to which a distal end portion of a wire is connected;

a housing that receives the terminal and the distal end portion of the wire in such a manner that the one end portion of the terminal is exposed and that the terminal and the distal end portion of the wire are disposed generally linearly;

a first support member which is disposed within the housing, and is fixed to the terminal, interposed between the housing and the terminal, slidable in a direction of an axis of the distal end portion of the wire within the housing; and a second support member which is disposed in the housing, and supports the terminal in a manner to allow the terminal to be moved in the axial direction of the distal end portion of the wire, and has a nut which is aligned with the bolt insertion hole of the terminal, wherein at the time when the bolt is passed through a bolt insertion hole of the mating terminal and the bolt insertion hole of the terminal and is screwed into the nut, the bolt is moved in a direction generally parallel to the axial direction of the distal end portion of the wire.

(2) The terminal-movable connector according to (1), wherein the first support member is integrally molded on the terminal.

(3) The terminal-movable connector according to (1), further comprising a third support member which is disposed within the housing, and supports the distal end portion of the wire so as to allow the distal end portion to be moved in the axial direction thereof, wherein the third support member is interposed between the housing and the distal end portion of the wire.

In the terminal-movable connector of the construction of the above Paragraph (1), for absorbing an offset of the mating terminal, it is only necessary to move the terminal connected to the wire, and therefore it is not necessary to use a bus bar for relay purposes as in the conventional connector, and besides it is not necessary to use two sets of bolts and nuts as in the conventional connector, and it is necessary to use only one set of bolt and nut. Therefore, the number of the parts is reduced, and besides the position of the terminal can be adjusted with the simple structure. Furthermore, the operation for screwing the bolt is a single operation, and therefore it is not necessary to provide many openings in the terminal-movable connector, and also it is not necessary to increase the outer size of the terminal-movable connector, and therefore the overall size of the terminal-movable connector can be reduced.

In the terminal-movable connector of the construction of the above Paragraph (2), the first support member is molded integrally on the terminal, and therefore these parts can be handled easily during an assembling operation, and besides the number of the parts around the terminal can be reduced.

In the terminal-movable connector of the construction of the above Paragraph (3), the distal end portion of the wire is supported by the third support member so as to slide in its axial direction within the housing, and therefore the movement of the terminal is sufficiently allowed, and besides the wire can be led out to the exterior without being bent or folded within the housing.

In the present invention, there can be provided the terminal-movable connector in which the number of parts can be reduced, and also the position of the terminal can be adjusted with the simple structure.

The present invention has been briefly described above. Details of the invention will become more manifest upon reading the following Section "Best Mode for Carrying Out the Invention" with reference to the accompanying drawings.

DETAILED DESCRIPTION OF PREFERRED EMBODIMENTS

A preferred embodiment of the present invention will now be described in detail with reference to the drawings.

Figure 1:
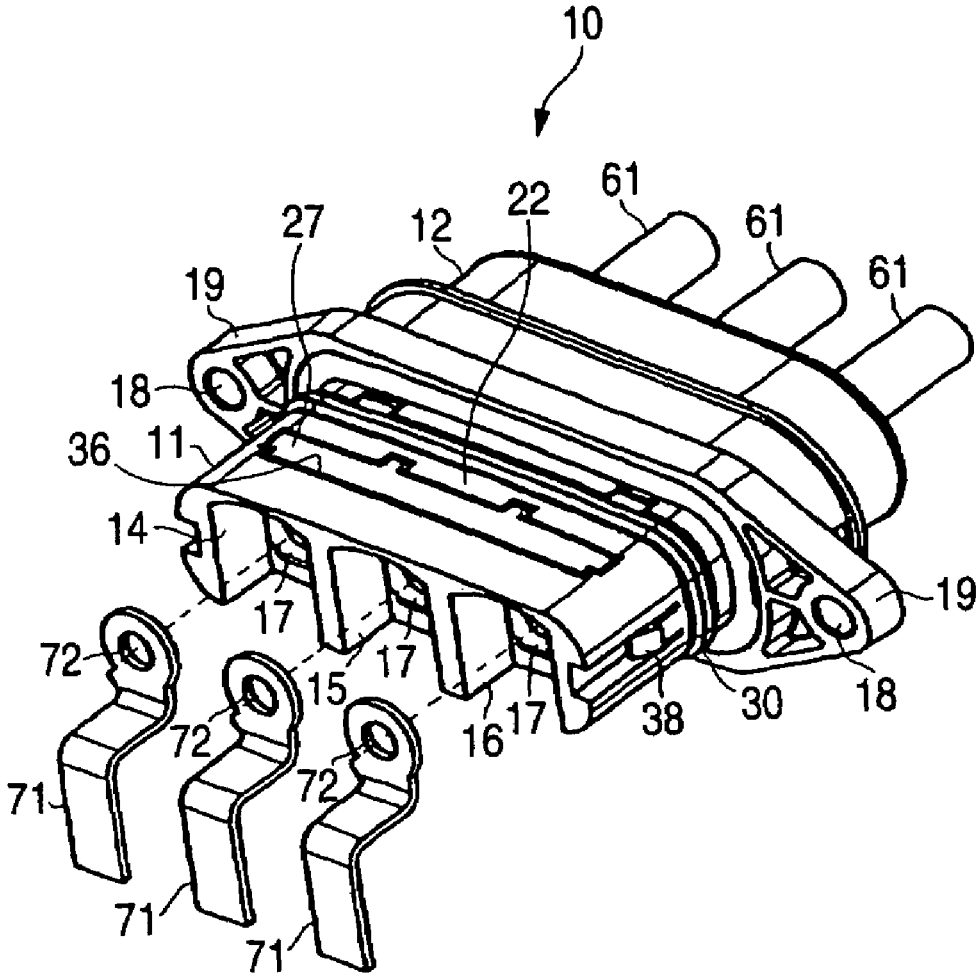
FIG. 1 is a perspective view showing one preferred embodiment of a terminal-movable connector of the present invention and mating terminals (The showing of an apparatus provided with these mating terminals is omitted.).
Figure 2:
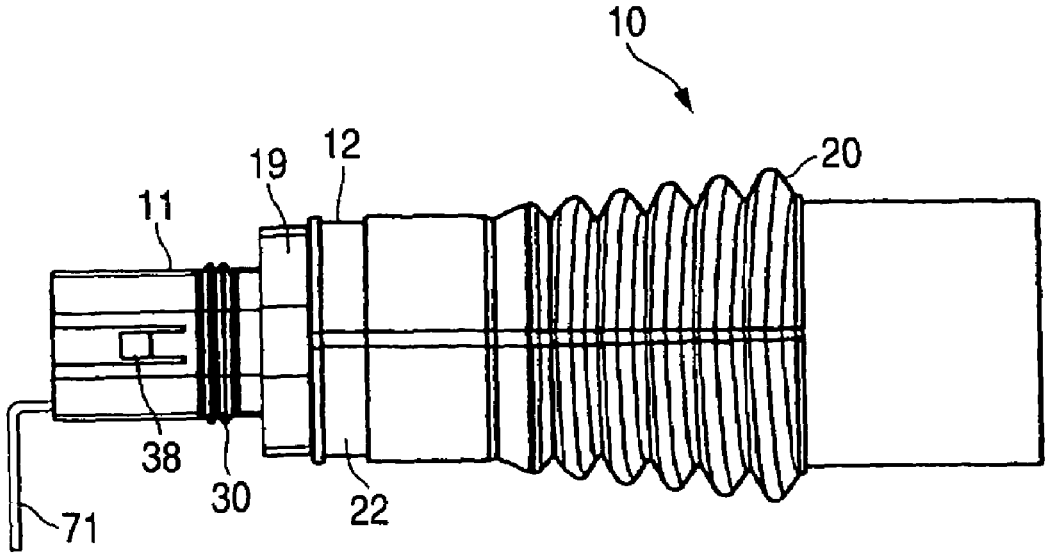
FIG. 2 is a side-elevational view of the terminal-movable connector of FIG. 1 in its assembled condition in which the mating terminals and a grommet are mounted on this connector.
Figure 3:
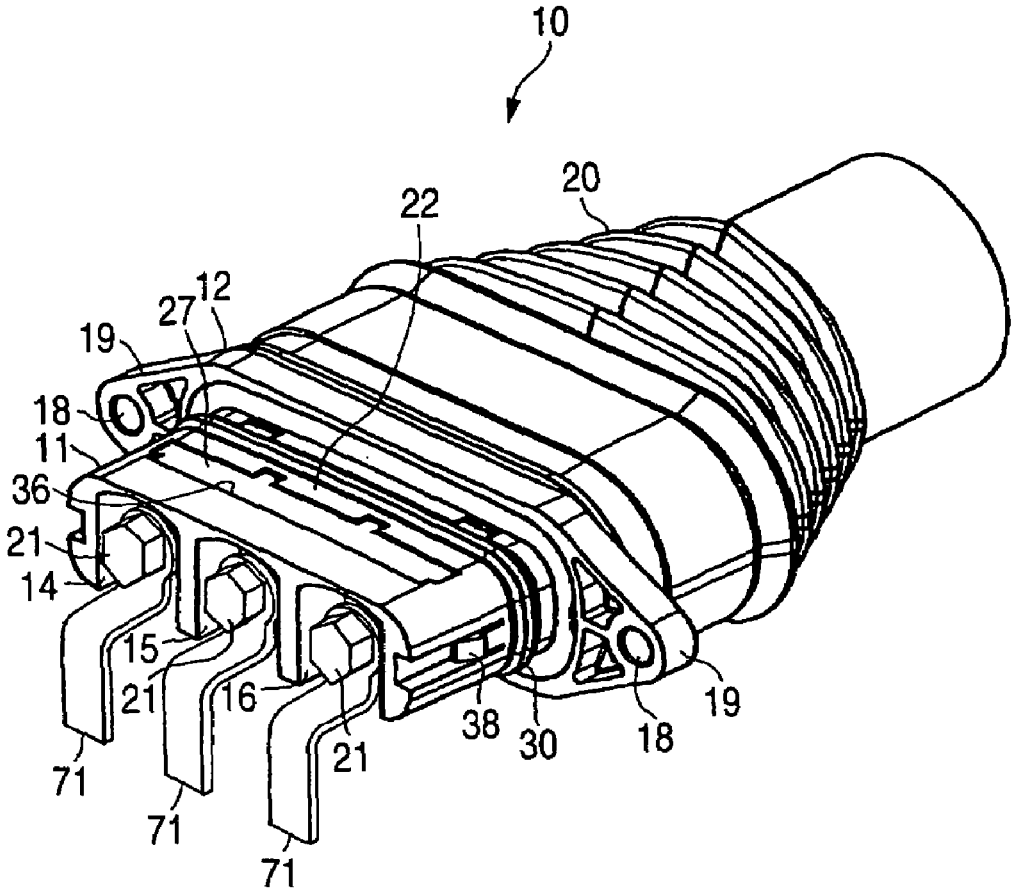
FIG. 3 is a perspective view of the terminal-movable connector of FIG. 2, showing its appearance.
Figure 4:
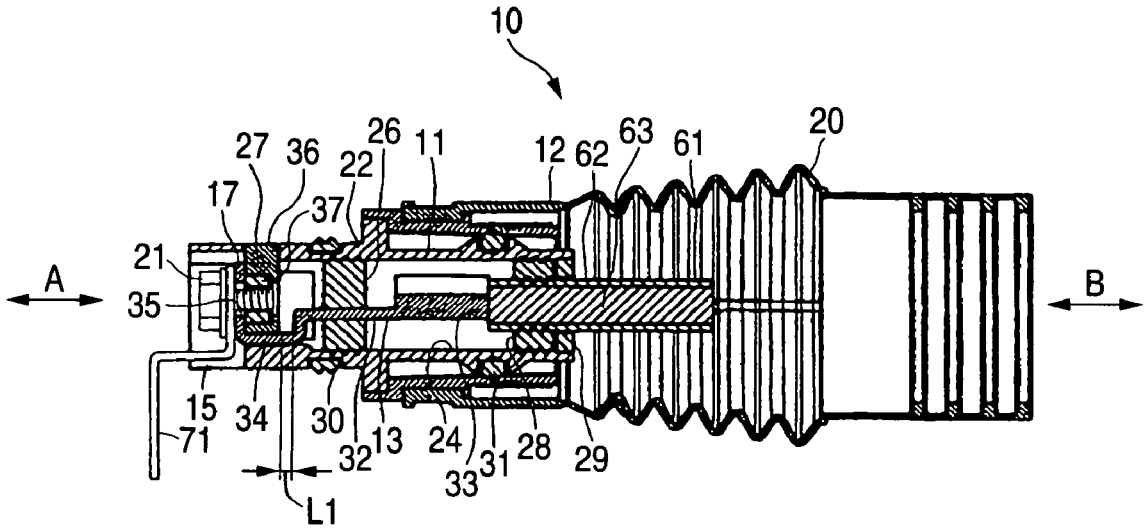
FIG. 4 is a vertical cross-sectional view of the terminal-movable connector of FIG. 3.
Figure 5:
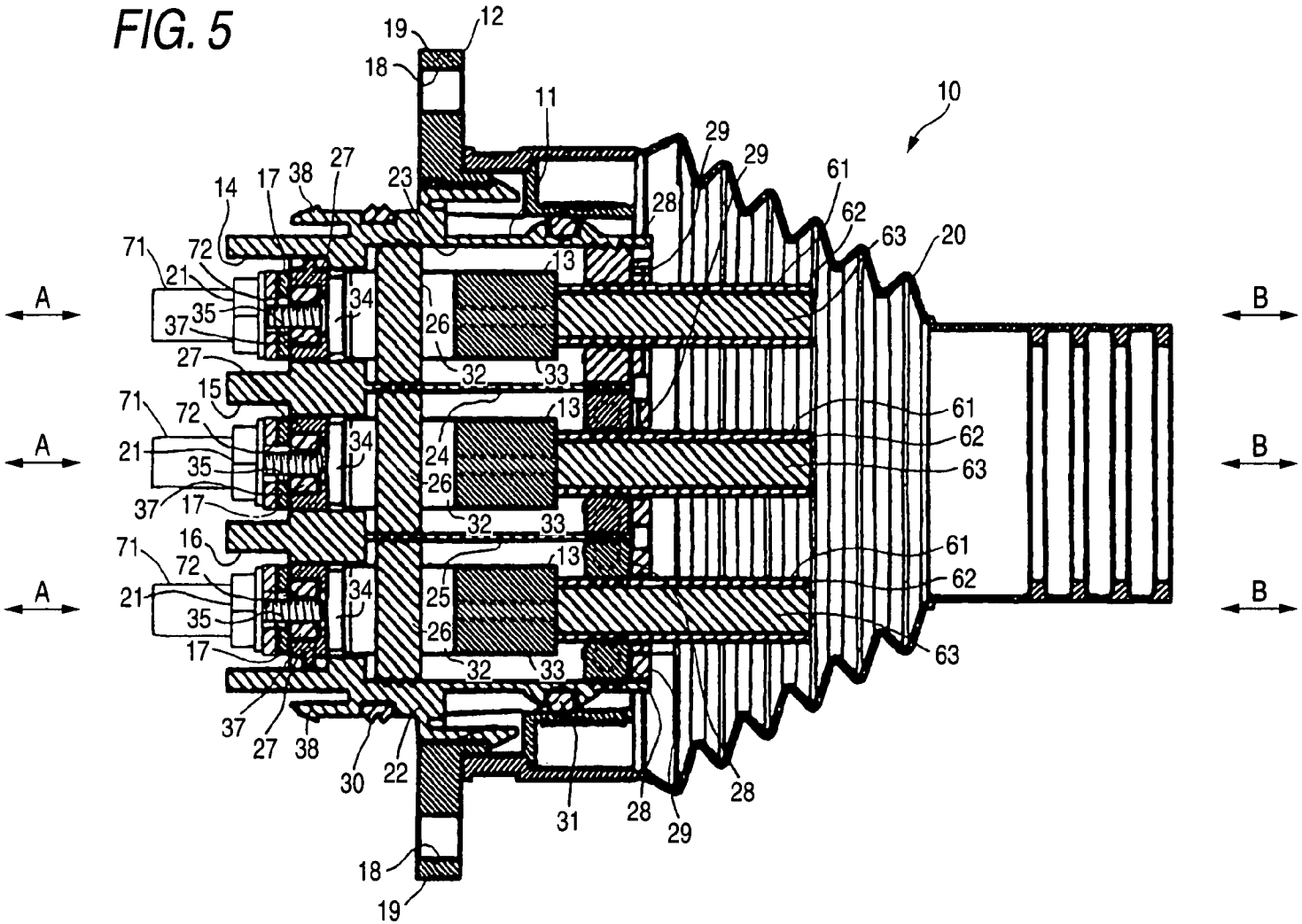
FIG. 5 is a horizontal cross-sectional view of the terminal-movable connector of FIG. 3.
Figure 6:
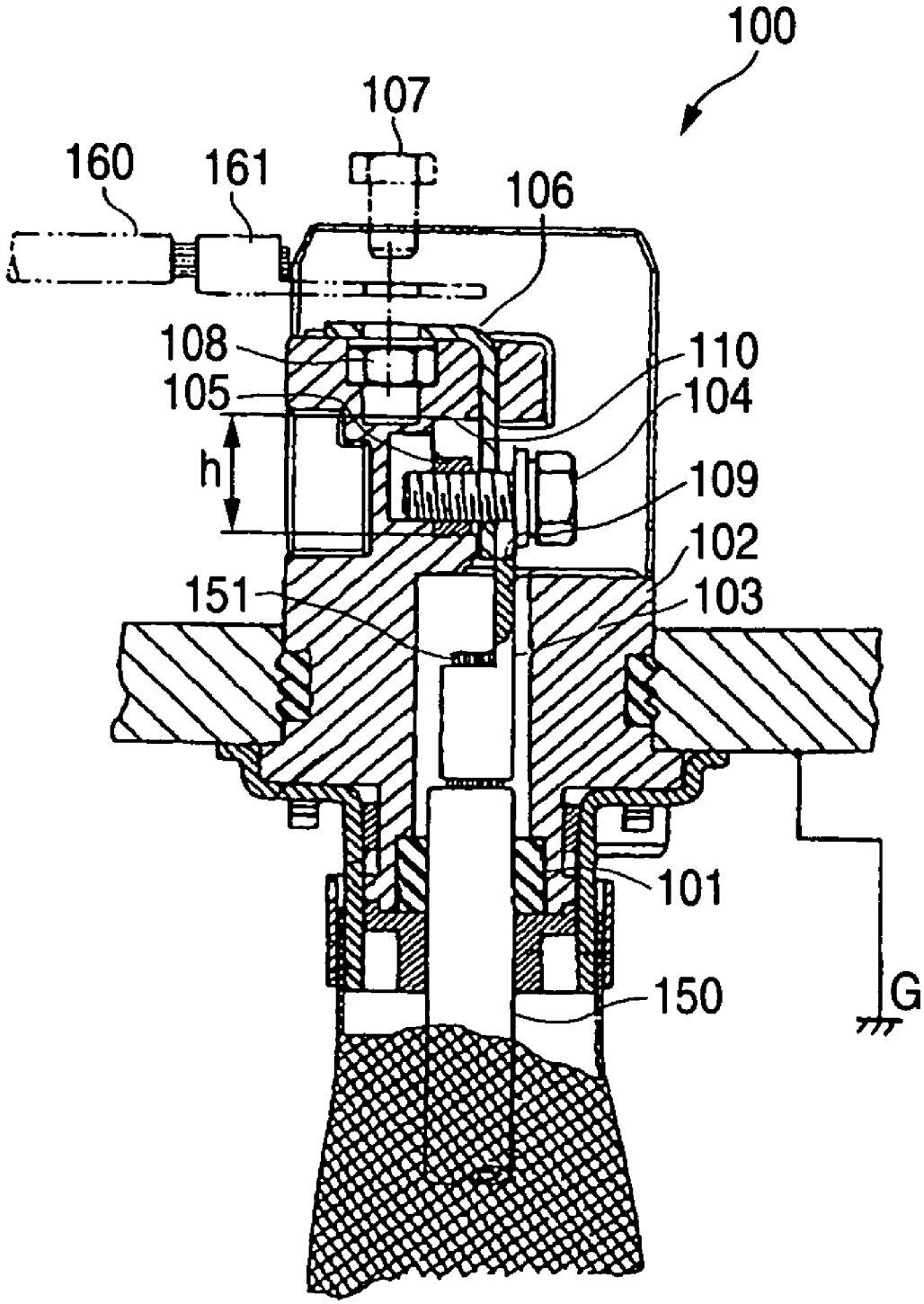
FIG. 6 is a cross-sectional view of a conventional terminal-movable connector.

FIG. 1 is a perspective view showing one preferred embodiment of a terminal-movable connector of the invention and mating terminals (The showing of an apparatus provided with these mating terminals is omitted.), FIG. 2 is a side-elevational view of the terminal-movable connector of FIG. 1 in its assembled condition in which the mating terminals and a grommet are mounted on this connector, FIG. 3 is a perspective view of the terminal-movable connector of FIG. 2, showing its appearance, FIG. 4 is a vertical cross-sectional view of the terminal-movable connector of FIG. 3, and FIG. 5 is a horizontal cross-sectional view of the terminal-movable connector of FIG. 3.

As shown in FIGS. 1 to 5, one preferred embodiment of the terminal-movable connector 10 the invention comprises three terminals 13, an inner housing 11, three first support members 26, a second support member 27, three third support members 28, and an outer housing 12. The three terminals 13 include respective electrical connection portions 17 (to which the mating terminals 17 can be screw-fastened by respective bolts 21) at their respective one end portions (that is, front end portions), and respective wire connection portions 33 (to which distal end portions of wires 61 are electrically connected, respectively) at their respective other end portions (that is, rear end portions). The inner housing 11 receives the terminals 13 and the distal end portions of the wires 61 in such a manner that the electrical connection portions 17 of the terminals 13 are exposed and that each terminal 13 and the distal end portion of the corresponding wire 61 are disposed generally linearly. The three first support members 26 are disposed within the inner housing 11, and are fixed respectively to the terminals 13 in such a manner that each first support member 26 is interposed between the inner housing 11 and the corresponding terminal 13, and these first support members 26 are slidable respectively in directions B (see FIGS. 4 and 5) of axes of the distal end portions of the wires 61, 61 and 61 within the inner housing 11. The second support member 27 is disposed in the inner housing 11, and supports the terminals 13 in a manner to allow the terminals 13 to be moved respectively in the axial directions B of the distal end portions of the wires 61, and has nuts 37 which are aligned respectively with bolt insertion holes 35 formed respectively through the electrical connection portions 17 of the terminals 13. The three third support members 28, 28 and 28 are disposed within the inner housing 11, and support the distal end portions of the respective wires 61 in a manner to allow these distal end portions to be moved respectively in the axial directions B, each third support member 28 being interposed between the inner housing 11 and the distal end portion of the corresponding wire 61.

At the time when the bolts 21 are passed respectively through bolt insertion holes 72 of the mating terminals 71 and the bolt insertion holes 35 of the electrical connection portions 17 of the terminals 13, and are screwed into the respective nuts 37, the bolts 21 are moved respectively in directions A (see FIGS. 4 and 5) generally parallel respectively to the axial directions B of the distal end portions of the wires 61. The first support members 26 are integrally molded on the terminals 13, respectively. Examples of such integral molding methods include a baking method.

Details of the terminal-movable connector 10 of this construction will be described below.

Three independent mating terminal-mounting portions 14, 15 and 16 are formed at a front end portion (that is, a mating terminal mounting-side end portion) of the synthetic resin-made inner housing 11, and the electrical connection portions 17 of the terminals 13 (each made of electrically-conductive metal) formed at their respective front end portions are disposed in an exposed manner in these mating terminal-mounting portions 14, 15 and 16, respectively.

The outer housing 12 is made of aluminum, and is formed into a tubular shape to cover the outside of the inner housing 11. Flanges 19 are formed respectively at opposite side portions of the outer housing 12, and have internally-threaded holes 18, respectively, through which the flanges 19 can be screw-fastened to a casing (not shown) of an external apparatus. The fixing of the flanges 19 to this casing is effected by screwing bolts respectively into the internally-threaded holes 18.

As shown in FIG. 2, the corrugated grommet 20 made of a synthetic resin is mounted on the rear end portion of the outer housing 12. The grommet 20 covers the wires 61 led out from the rear end of the inner housing 11.

In the terminal-movable connector 10, the mating terminals 71 each made of electrically-conductive metal are located respectively in the mating terminal-mounting portions 14, 15 and 16, and then the bolts 21 are screwed, so that the terminals 13 are electrically connected respectively to the mating terminals 17 as shown in FIG. 3.

As shown in FIGS. 4 and 5, the inner housing 11 has three independent terminal receiving chambers 23, 24 and 25 formed within a tubular inner housing body 22. The terminals 13, the first support members 26, the second support member 27, the third support members 28 and rear holders 29 are mounted in the respective terminal receiving chambers 23, 24 and 25. A first seal member 30 and a second seal member 31 are fitted on the outer peripheral surface of the inner housing 11.

The terminals 13 have the same shape. Therefore, here, description will be made with reference to the central terminal 13 among the three terminals 13. The terminal 13 includes a flat plate-like terminal body 32, and the wire connection portion 33 is formed at a rear end portion of the terminal body 32, and a bent portion 34 bent into a generally U-shape is formed at a front end portion of the terminal body 32, and the electrical connection portion 17 is formed at a front end of the bent portion 34, and extends in a direction perpendicular to the axial direction B of the distal end portion of the wire 61. A sheath portion 62 of the distal end portion of the wire 61 is fixed by press-clamping to the wire connection portion 33, and a conductor (core wire) 63 of the wire 61 is electrically connected to the wire connection portion 33.

The first support member 26 is made of an elastic material such as acrylic rubber, and is molded integrally on a generally central portion of the terminal 13, and is fitted in a generally central portion of the terminal receiving chamber 24. When a force, acting in the axial direction B of the distal end portion of the wire 61, is applied to the terminal 13, the first support member 26 is elastically deformed so as to adjust the position of the terminal 13.

The second support member 27 is made of a synthetic resin, and is disposed at the inside of the bent portion 34 of the terminal 13, and prevents the terminal 13 from being withdrawn forwardly from the inner housing 11. The second support member 27 is disposed such that a bottom wall of the bent portion 34 of the terminal 13 can slide in a gap between the second support member 27 and an inner surface of the terminal receiving chamber 24. The second support member 27 can abut against the electrical connection portion 17 of the terminal 13, and also can abut against one inner side surface of the bent portion 34. The second support member 27 is incorporated in the inner housing 11, and is held in position by a support member fixing hole 36 formed in the inner housing body 22. The three nuts 37 are received in the second support member 27 so as to slide respectively in the directions A of movement of the bolts 21. Even when there is a relative offset between the electrical connection portion 17 of the terminal 13 and the mating terminal 71 in the direction A of movement of the bolt 21, the second support member 27 allows the position of the terminal 13 to be adjusted in the direction A of movement of the bolt 21 in an amount corresponding to a gap L1 between the second support member 27 and the other inner side surface of the bent portion 34 so that the electrical connection portion 17 can be properly positioned relative to the mating terminal 71.

The third support member 28 is made of an elastic material such as rubber (e.g. silicone rubber), and has a hole formed through a central portion thereof, and the wire 61 is passed through this hole. The third support member 28 is mounted in the rear end portion of the terminal receiving chamber 24, and more specifically the third support member 28 forms a liquid-tight seal between an inner peripheral surface of the rear open end portion of the terminal receiving chamber 24 and the outer peripheral surface of the wire 61.

The rear holder 29 is made of a synthetic resin, and is mounted in the rear end portion of the terminal receiving chamber 24 to prevent the third support member 28 from being withdrawn from the terminal receiving chamber 24.

The first seal member 30 is made of acrylic rubber, and has an annular shape, and is fitted on the outer peripheral surface of the inner housing 11, and is disposed in the vicinity of a pair of retaining piece portions 38 formed at the front end portion of the inner housing 11. When the casing (not shown) to be connected to the terminal-movable connector 10 is engaged with the retaining piece portions 38 and 38, the first seal member 30 forms a liquid-tight seal between the inner housing 11 and this casing.

The second seal member 31 is made of silicone rubber, and has an annular shape, and is fitted on the outer peripheral surface of the inner housing 11 at the rear end portion thereof when the outer housing 12 is mounted on the inner housing 11, the second seal member 31 forms a liquid-tight seal between the outer housing 12 and the inner housing 11.

For electrically connecting the terminals 13 respectively to the mating terminals 17, each mating terminal 71 is closely opposed to the electrical connection portion 17 of the corresponding terminal 13 exposed at the mating terminal-mounting portion 14, 15, 16, and in this condition each bolt 21 is passed through the bolt insertion hole 72 of the corresponding mating terminal 71 and the insertion hole 35 of the corresponding electrical connection portion 17, and is screwed into the corresponding nut 37 in the second support member 27, and by doing so, each terminal 13 is electrically connected to the corresponding mating terminal 17. At this time, even when each electrical connection portion 17 is offset relative to the corresponding mating terminal 71 (In other words, the mating terminal 71 is offset relative to the electrical connection portion 17), the terminal 13 is slidingly moved toward the front end of the inner housing 11 in accordance with the sliding movement of the first support member 26 to thereby absorb the offset, since the position of the terminal 13 can be adjusted in an amount corresponding to the gap L1 between the second support member 27 and the other inner side surface of the bent portion 34 of the terminal 13. As a result, the electrical connection portion 17 thus moved toward the front end of the inner housing 11 is fixed to the mating terminal 71, so that the electrical connection portion 17 and the mating terminal 71 are electrically connected together.

As described above, in the terminal-movable connector 10, for absorbing an offset of each mating terminal 71, it is only necessary to move the corresponding terminal 13 connected to the wire 61, and therefore it is not necessary to use a bus bar for relay purposes as in the conventional connector, and besides it is not necessary to use two sets of bolts and nuts as in the conventional connector, and it is only necessary to use one set of bolt 21 and nut 37 for each pair of terminal 31 and mating terminal 71. Therefore, the number of the parts is reduced, and besides the position of each terminal 13 can be adjusted with the simple structure. Furthermore, the operation for screwing each bolt 21 is a single operation, and therefore it is not necessary to provide many openings in the terminal-movable connector 10, and also it is not necessary to increase the outer size of the terminal-movable connector 10, and therefore the overall size of the terminal-movable connector 10 can be reduced.

Furthermore, in the terminal-movable connector 10, the first support members 26 are molded integrally on the terminals 13, respectively, and therefore these parts can be handled easily during the assembling operation, and besides the number of the parts around the terminals 13 can be reduced.

Furthermore, in the terminal-movable connector 10, the distal end portions of the wires 61 are supported respectively by the third support members 28 so as to slide in their respective axial directions B within the inner housing 11, and therefore the movement of each terminal 13 is sufficiently allowed, and besides each wire 61 can be led out to the exterior without being bent or folded within the inner housing 11.

The present invention is not limited to the above embodiment, and suitable modifications, improvements, etc., can be made. Furthermore, the material, shape, dimensions, numerical values, form, number, disposition, etc., of each of the constituent elements of the above embodiment are arbitrary, and are not limited in so far as the invention can be achieved.

For example, the number of the terminals, the number of the wires and the number of the associated parts are not limited to those in the illustrated embodiment, and when at least one is provided for each of these constituent parts, the invention can be achieved.

What is claimed is:

1. A terminal-movable connector comprising:

a terminal that includes one end portion having a bolt insertion hole through which a mating terminal can be fixed to the one end portion by a bolt, and the other end portion to which a distal end portion of a wire is connected;

a housing that receives the terminal and the distal end portion of the wire in such a manner that the one end portion of the terminal is exposed and that the terminal and the distal end portion of the wire are disposed generally linearly;

a first support member which is disposed within the housing, and is fixed to the terminal, interposed between the housing and the terminal, slidable in a direction of an axis of the distal end portion of the wire within the housing; and a second support member which is disposed in the housing, and supports the terminal in a manner to allow the terminal to be moved in the axial direction of the distal end portion of the wire, and has a nut which is aligned with the bolt insertion hole of the terminal, wherein at the time when the bolt is passed through a bolt insertion hole of the mating terminal and the bolt insertion hole of the terminal and is screwed into the nut, the bolt is moved in a direction generally parallel to the axial direction of the distal end portion of the wire.

2. The terminal-movable connector according to claim 1, wherein the first support member is integrally molded on the terminal.

3. The terminal-movable connector according to claim 1, further comprising a third support member which is disposed within the housing, and supports the distal end portion of the wire so as to allow the distal end portion to be moved in the axial direction thereof, wherein the third support member is interposed between the housing and the distal end portion of the wire.

* * * * *